US005845403A

United States Patent [19]

Nivin

[11] Patent Number: 5,845,403

[45] Date of Patent: Dec. 8, 1998

[54] NESTABLE DUAL-END EATING UTENSIL

[76] Inventor: Eli Nivin, 778 Warburton Ave., Yonkers, N.Y. 10701

[21] Appl. No.: 527,483

[22] Filed: Sep. 13, 1995

[51] Int. Cl.[6] ..... A47J 43/28

[52] U.S. Cl. ..... 30/147; 30/322; 30/324

[58] Field of Search ..... 30/142, 147–150, 30/322, 324

[56] References Cited

U.S. PATENT DOCUMENTS 32,916 7/1861 Richards ..... 30/147

1,288,617 12/1918 Kupiszewski ..... 30/149 X

FOREIGN PATENT DOCUMENTS 201258 6/1958 Austria ..... 30/147

*Primary Examiner*—Douglas D. Watts

[57] ABSTRACT

A nestable set of two, selectively-detachable,, dual-end eating utensils having a temporal clipping mechanism to hold the eating utensils in a secure position during non-use periods.

8 Claims, 3 Drawing Sheets

1
21
20
23
11
24
26
15
10
13
14
22a
22
12a
12

25
23
23a
24
15
14
27
26
13

42a
42
40
2
44
30
32
41
43
34
34a
32a
31
33a
33

34a
34
34a
44
43

33

FIG. 5
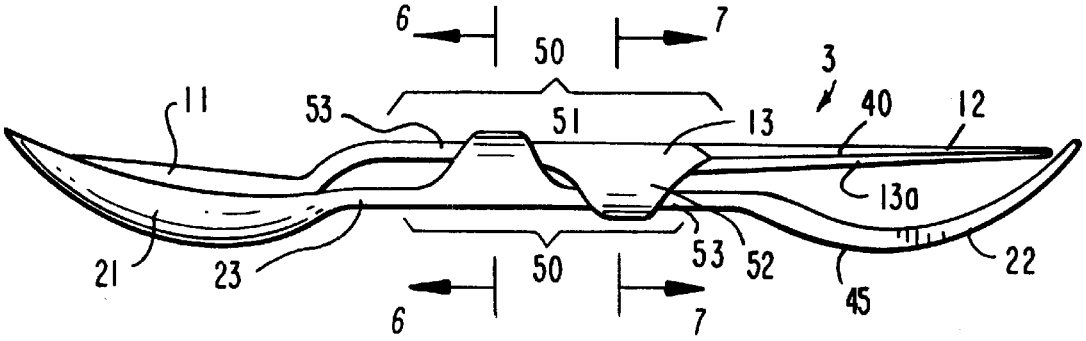
FIG. 6
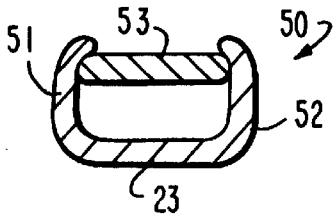
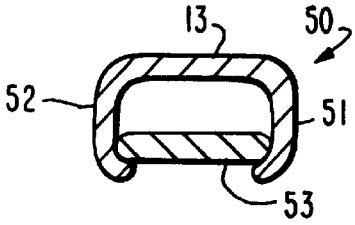
FIG. 7

FIG. 8
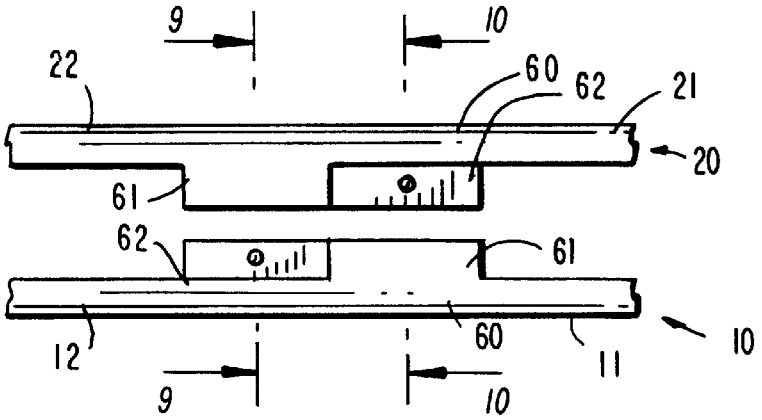
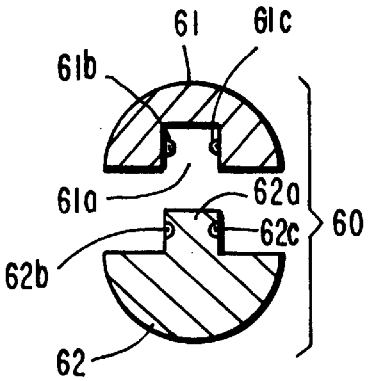
FIG. 9
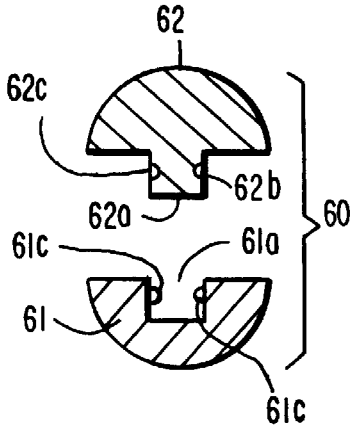
FIG. 10

NESTABLE DUAL-END EATING UTENSIL

BACKGROUND OF THE INVENTION

The present invention generally relates to eating utensils. More specifically, this invention relates to nestable, dual-end eating utensils.

Nestable eating utensils are known in the art. Eating utensils having this construction have been disclosed to provide compact and portable combinations of the well-known eating implements. Nestable eating utensils are useful for military, outing, cafeteria and like purposes. U.S. Pat. No. 33,703 to Hardie discloses, in combination, a knife having a sleeved handle portion, a fork having a sleeved handle portion and a conventional spoon. The spoon handle is nestable in the sleeve of the fork handle and the sleeved handle portion of the fork is nestable in the sleeve of the knife handle. U.S. Pat. No. 33,730 to Ames discloses a nestable knife, fork and spoon combination wherein the spoon and fork are selectively attachable by screw means to portions of the knife blade. U.S. Pat. No. 34,069 to Neill discloses a nestable knife, fork and spoon combination wherein the knife or spoon has a sheath formed at an end thereof which receives portions of the other utensils. U.S. Pat. No. 34,096 to Hardie et al. discloses a knife having a laterally-folded handle portion that receives a conventional fork and spoon. In U.S. Pat. No. 34,338 to Ulmer a nestable knife, fork and spoon is disclosed wherein the spoon handle includes an aperature which threadedly receives the respectives handles of the knife and fork. U.S. Pat. No. 1,053,387 to Hawley discloses a nestable combination of eating utensils wherein edge flanges are formed on opposing sides of a knife handle, and a fork and spoon have longitudinal edges that selectively project beneath the flanges of the knife handle. U.S. Pat. No. 4,524,512 to Formo et al. discloses nestable and stackable eating utensils which include nesting and stacking lugs formed in the handles of the respective utensils. In U.S. Pat. No. 4,995,154 to Bamber nestable eating utensils are disclosed wherein a knife and fork are formed having dovetail locking portions in the respective food engagement portions thereof. A spoon includes locking flanges and a stop flanges formed at the distal end of the handle portion of the spoon. The handle portions of the knife and fork engage the locking flanges of the spoon. U.S. Pat. No. 5,327,650 to Rojas discloses a nestable set of eating utensils wherein the handle of a knife includes a plurality of parallel side walls which engage respective handle-receiving channels formed in the handle of a fork and the handle of a spoon.

Combination eating utensils, i.e. eating utensils having a variety of food engagement portions in a single structure, are also well known in the art. Various knife, fork and spoon combinations in a single structure have been disclosed in the prior art. U.S. Pat. No. 33,285 to Ames discloses a knife, fork and spoon combined in a single structure wherein a spoon, fork or forked spoon is formed at the projecting end of a knife blade. Further examples of combination eating utensils in a single structure illustrative of the prior art are disclosed in U.S. Pat. No. 147,119 to Francis; U.S. Pat. No. 462,068 to Sheppman; U.S. Pat. No. 843,953 to Laramy; U.S. Pat. No. 2,185,942 to Frank; U.S. Pat. No. 2,473,288 to McNeill; U.S. Pat. No. 2,542,600 to Vaccarezza; U.S. Pat. No. 2,839,830 to Neiman, Jr.; U.S. Pat. No. 4,535,538 to Nelson; and U.S. Pat. No. 4,984,367 to Albanese.

A variation of the combination eating utensil is the dual-end eating utensil. This construction of a combination eating utensil provides separate food engagement portions at opposing ends of a common handle portion. U.S. Pat. No. 34,718 to Cables discloses a dual-end eating utensil wherein a knife food engagement portion, a spoon food engagement portion and a fork food engagement portion are respectively rotatably attached to engage slots formed in a handle substantially the size and construction of a pocket knife handle. U.S. Pat. No. 1,488,463 to Abram discloses a dual end table utensil consisting of a spoon having its bowl portion at one end integrally formed with a handle portion. The spoon bowl portion and handle portion are divided longitudinally into two equal parts that are detachably engaged. A separate utensil, either a knife, fork or two half-spoons, is formed at the opposite ends of the two detachable parts of the handle portion. U.S. Pat. No. 2,318,129 to Torode discloses a dual-end eating utensil having a fork at one end, a spoon at the opposing end and a knife blade disposed to one side of the fork.

Nestable dual-end eating utensils are also known in the prior art. U.S. Pat. No. 32,916 to Richards discloses a nestable set of dual-end eating utensils wherein a knife includes opposing, upturned lips formed on its handle portion and a dual-end spoon/fork implement includes opposing, upturned lips formed on the common handle portion thereof. The tines of the fork in the spoon/fork implement engage the upturned lips of the knife handle and the knife blade engages the upturned lips of the common handle of the spoon/fork implement. In U.S. Pat. No. 972,777 to Richardson a nestable dual-end spoon/knife implement has the spoon food engagement portion and the knife food engagement portion pivotally attached to each other. A fork implement detachably engages the spoon/knife implement by pin means.

A limitation of the prior art nestable combination eating utensils is that to permit nestable attachment the food engagement portions thereof are generally formed smaller than a conventional eating utensil or are constructed in non-conventional shapes. Such constructions interfere with normal eating pleasure. Therefore, it is desirable in the art to provide nestable combination eating utensils which include food engagement portions of conventional size and shape. A further problem with the nestable, combination eating utensils of the prior art is displacement of the respective implements from their nested position during storage or other non-use periods. Premature displacement of the respective utensils in nested combinations limits the utility of these constructions in two ways. Firstly, displaced utensils may be more readily lost from each other if not securely attached during non-use periods. Secondly, displaced dual end utensils are more likely to be broken during storage or transport than nested utensils. This problem is particularly relevant when the utensils are made from plastic or like materials. Prior art combination eating utensils have utilized various methods to resist displacement of the respective utensils during non-use periods. In the aforementioned patent to Ulmer the elasticity of the fork tines is used to hold the combination in place during non-use periods. In the Hawley reference spring tension formed by bending the prong portion of the fork and the bowl portion of the spoon to a greater degree than ordinarily necessary in the construction of individual utensils is provided to resist movement of the respective utensils during non-use periods. In the aforementioned nestable combination eating utensil to Bamber dovetail locking portions formed in the knife and fork interfit to resist respective displacement. Pin means are also utilized in the prior art to prevent displacement of nested eating utensils. While the foregoing constructions to prevent displacement of separable implements may be suitable for metal utensils they are not suitable for nestable, combination eating utensils formed from plastic or like materials.

A further limitation of plastic and the like eating utensils is their environmental impact. Disposal of used plastic materials is a widely-recognized problem. The disposal of plastic eating utensils adds to this problem. Therefore, it is desirous in the art to provide a plastic eating utensil that is environmentally-friendly.

The term "environmentally-friendly" generally refers to products having a material composition which returns relatively quickly to the Earth. This is one approach. A different approach, recognized in the present invention, is to reduce the number of disposals of a plastic product by extending the product's actual or perceived useful life. Present plastic eating utensils are generally disposed of after a single use. An eating utensil that encourages re-use and retention instead of immediate disposal after a single use reduces the rate of plastic waste buildup and thereby has a positive impact on the environment. Re-use of a plastic or the like eating utensil also is encouraged by providing a set of novel, nestable eating utensil having a visible, outward portion upon which a trademark, logo, or other commercial symbol can be printed or affixed. Securing a nestable set of eating utensils against premature displacement also enhances re-use and keepsake value. Additionally, to provide a complete set of utensils for all eating tasks requires the use of a relative substantial amount of plastic that will eventually have to be disposed of. Providing a set of dual-end eating utensils having the four implements required for all eating tasks in a construction using substantially the same amount of plastic to construct two utensils also reduces the amount of waste plastic.

The prior art nestable, dual-end eating utensils do not meet some or all of the foregoing limitations. These and other limitations of the prior art utensils are overcome by the invention of the present disclosure.

SUMMARY OF THE INVENTION

The present invention is a nestable, dual-end set of two eating utensils having a cooperatively-engaging clipping mechanism formed in the common handle portions of respective dual-end utensils. In first embodiments of the present invention a clip locking receptacle is formed in the handle portion of a first dual-end eating utensil and a clip locking arm is formed in the handle portion of a second dual-end eating utensil. The respective receptacle and arm cooperatively engage to prevent displacement of the first and second eating utensils during a non-use period. Further embodiments of the present invention disclose androgynous clipping mechanisms in respective handle portions of the two utensils.

An object of the present invention is to provide a nestable set of dual-end eating utensils.

Another object of the present invention is to provide a nestable set of dual-end eating utensils wherein the food engagement portions thereof are formed in conventional sizes and shapes.

Another object of the present invention is to minimize the number of separate utensils required for all eating tasks.

A further object of the present invention is to provide implements for all eating tasks in two utensils.

A still further object of the present invention is to provide a set of dual-end eating utensils that are nestable in a manner that prevents vertical, longitudinal and lateral displacement of the respective dual-end eating utensils during non-use periods.

It is also an object of the present invention to provide a nestable set of dual-end eating utensils that is suitable for construction from metal as well as plastic or like material.

Another object of the present invention is to provide a set of plastic or like eating utensils that encourages re-use instead of immediate disposal after a single use.

Another object of this invention is to provide a keepsake eating utensil.

A further object of the present invention is to provide the requisite four implements for all eating tasks in a set of utensils that is constructed with substantially the same amount of plastic used to construct two implements in the prior art.

It is also an object of the present invention to provide a set of nestable, plastic eating utensils suitable for printing or affixation of a trademark, logo or other commercial symbol.

These and other objects and advantages of the present invention will be apparent to those skilled in the art from the following description of preferred embodiments, claims and appended drawings.

BRIEF DESCRIPTION OF THE DRAWINGS

FIG. 5 is a side elevational view of a third set of dual-end eating utensils having a first preferred embodiment of an androgynous clipping mechanism constructed in accordance with the teachings of the present invention.

FIG. 6 is a cross-sectional view of the first androgynous clipping mechanism taken along line 6—6 of FIG. 5.

FIG. 7 is a cross-sectional view of the first androgynous clipping mechanism taken along line 7—7 of FIG. 5.

FIG. 8 is a fragmented side elevational view of a second androgynous clipping mechanism for a dual-end eating utensil constructed in accordance with the teachings of the present invention.

FIG. 9 is a lateral cross-sectional view taken along line 9—9 of FIG. 8.

FIG. 10 is a lateral cross-sectional view taken along line 10—10 of FIG. 8.

DESCRIPTION OF A PREFERRED EMBODIMENTS

Figure 1:
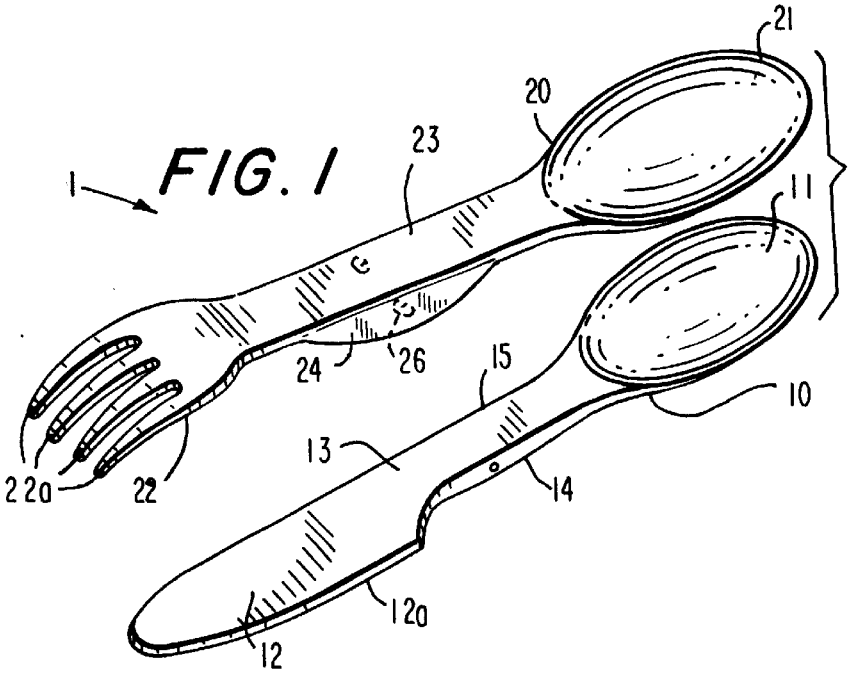
FIG. 1 is an exploded top perspective view of a first preferred embodiment of a nestable set of dual-end eating utensils constructed in accordance with the teachings of the present invention.

FIG. 1 illustrates in an exploded top perspective view a first preferred embodiment of the nestable set of dual-end eating utensils 1 of the present invention. First eating utensil 1 includes a first dual-end knife/spoon implement 10 and a first dual-end fork/spoon implement 20. First knife/spoon implement 10 is formed having a first spoon-food engagement portion 11 and a first knife-food engagement portion 12 formed at opposing ends of a first handle portion 13. First handle portion 13 further includes first and second clip locking slots 14, 15 formed in opposing sides of the first handle portion 13. As will be hereinafter described in greater detail the respective clip locking slots 14, 15 are engaged by clip locking arms formed in the dual-end fork/spoon implement 20 to retain the first utensil 1 in a nested position. The first spoon-food engagement portion 11 of first knife/spoon implement 10 is turned upwardly and is formed having the size and shape of a conventional teaspoon. The knife food engagement portion 12 of knife/spoon implement 10 is formed having the cutting edge 12*a* disposed laterally.

First fork/spoon implement 20 is formed having a second spoon-food engagement portion 21 and a first fork-food engagement portion 22 formed at opposing ends of a second handle portion 23. Second handle portion 23 further includes first and second clip locking arms 24, 25 extending vertically downward from the bottom surface 23*a* of second handle portion 23. The respective clip locking arms 24, 25 further include respective first and second clip locking fingers 26, 27 (FIG. 2) which extend laterally inward from the respective clip locking arms 24, 25. The first and second clip locking fingers 26, 27 of first fork/spoon implement 20 engage the respective first and second clip locking slots 14, 15 of first knife/spoon implement 10 to prevent lateral displacement of the respective implements 10, 20 from each other. First and second clip locking arms 24, 25 are formed having lateral flexibility so that the fingers 26, 27 can spread and clip locking arms 24, 25 are sufficiently resilient so that arms 24, 25 can engage the respective clip locking slots 14, 15 formed in first knife/spoon implement 10 after being spread by the clipping engagement. The second spoon-food engagement portion 21 of first fork/spoon implement 20 is turned upwardly and is formed having the size and shape of a conventional tablespoon. The first fork-food engagement portion 22 of first fork/spoon implement 20 is formed having the fork tines 22*a* turned downwardly. These arrangements of the food engagement portions 11, 12, 21, 22 of the respective first implements 10, 20 facilitate nesting of the set of utensils 1.

Figure 2:
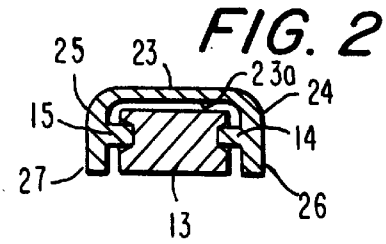
FIG. 2 is an enlarged lateral cross-sectional view of the handle portion of the first eating utensil shown in a secured nested position.

FIG. 2 illustrates an enlarged lateral cross-sectional view of the respective first and second handle portions 13, 23 of first utensil 1 disposed in a nested position. Therein it can been seen that when first knife/spoon implement 10 is engaged with first fork/spoon implement 20, the lateral resiliency of the first and second clip locking arms 24, 25 of first fork/spoon implement 20 permits the clip locking fingers 26, 27 to spread apart and thereafter engage the clip locking slots 14, 15 of first knife/spoon implement 10. Thereby the nested implements 10, 20 are prevented from lateral displacement relative to each other.

Figure 3:
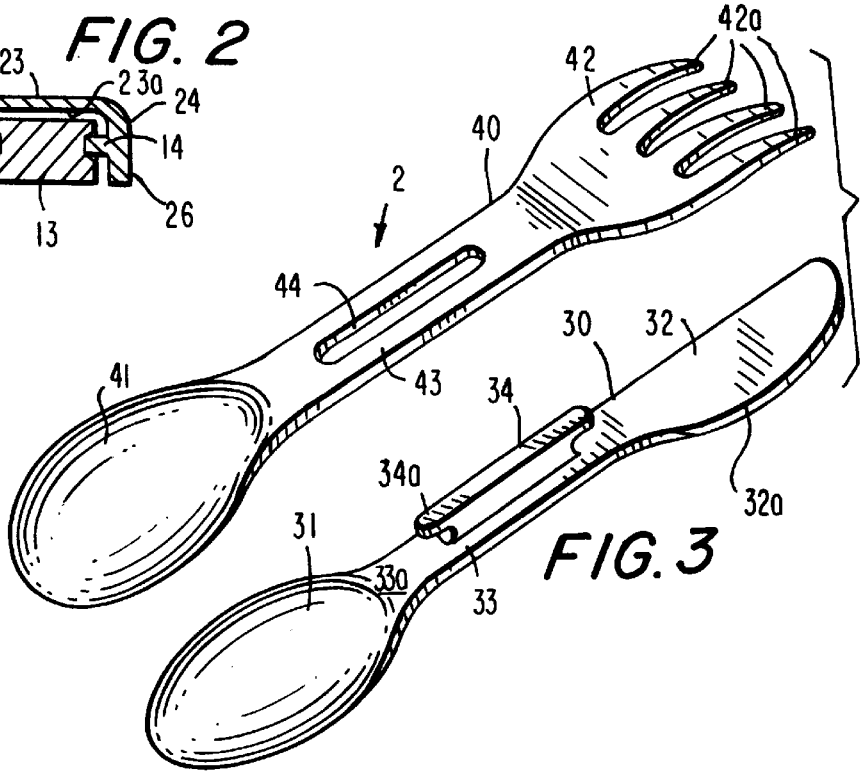
FIG. 3 is an exploded top perspective view of a second preferred embodiment of a nestable set of dual-end eating utensils constructed in accordance with the teachings of the present invention.

FIG. 3 illustrates in an exploded top perspective view a second preferred embodiment of the nestable set of dual-end eating utensils 2 constructed in accordance with the teachings of the present invention. Second eating utensil 2 includes a second dual-end knife/spoon implement 30 and a second dual-end fork/spoon implement 40. Second knife/spoon implement 30 is formed having a third spoon-food engagement portion 31 and a second knife-food engagement portion 32 formed at respective ends of a third handle portion 33. Third handle portion 33 further includes an upright clipping arm 34 disposed on a top surface 33*a* of the third handle portion 33. Upright clipping arm 34 engages a clip locking slot 44 formed in fork/spoon implement 40 of the second eating utensil 2 as hereinafter described in greater detail. In addition to its use to engage the second utensil 2 in a secured nested position, upright clipping arm 34 has a further utility for use as a finger lever when second knife-food engagement portion 32 is used to cut food or the like. The third spoon-food engagement portion 31 of the second knife/spoon implement 30 in second utensil 2 is turned upwardly and is formed having the size and shape of a conventional teaspoon. The second knife-food engagement portion 32 of second knife/spoon implement 30 is formed having the cutting edge 32*a* disposed laterally.

Second fork/spoon implement 40 is formed having a fourth spoon-food engagement portion 41 and a second fork-food engagement portion 42 formed at respective ends of a fourth handle portion 43. Fourth handle portion 43 includes a clip locking slot 44 formed in a central portion of the fourth handle portion 43. Clip locking slot 44 substantially comprises a longitudinal opening extending through fourth handle portion 43. Upright clipping arm 34 engages the clip locking slot 44 in a snap fit to secure the second utensil 2 in a nested position. The fourth spoon-food engagement portion 41 of the second fork/spoon implement 40 is turned upwardly and is formed having the size and shape of a conventional tablespoon. The second fork-food engagement portion 42 of second fork/spoon implement 40 is formed having the fork tines 42*a* also turned upwardly.

Figure 4:
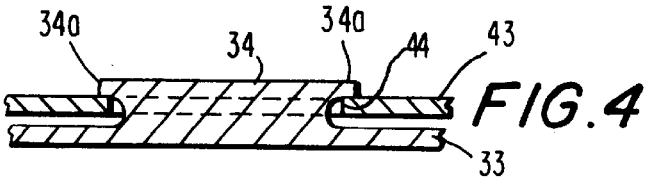
FIG. 4 is an enlarged, lateral cross-sectional view of the handle portion of the second eating utensil shown in a secured, nested position.

FIG. 4 illustrates an enlarged lateral cross-sectional view of the nested handle portions 33, 43 of second utensil 2. Therein it can be seen that upright clipping arm 34 is formed having clipping arm head 34*a* that is marginally wider than the clip locking slot 44. This construction allows snap-fit engagement of the upright clipping arm 34 into clip locking slot 44 whereupon the longitudinal walls of clip locking slot 44 spread and retract to receive the clipping arm head 34*a*.

As heretofore mentioned upright clipping arm 34 has an additional utility in conjunction with the second knife-food engagement portion 32 of second knife/spoon implement 30. When second knife-food engagement portion 32 is being used to cut food and the like, a finger of the user's hand may be placed on the side of the upright clipping arm 34 for leverage.

FIG. 5 illustrates in a side elevational view a third nested set of dual-end eating utensils 3 constructed having a first androgynous clipping mechanism 50. First androgynous clipping mechanism 50 is formed having both male and female characteristics in a single structure. Third eating utensil 3 includes a third dual-end knife/spoon implement 40 and a third dual-end fork/spoon implement 45. Third knife/spoon implement 40 is formed having a first spoon-food engagement portion 11 and a first knife-food engagement portion 12 formed at respective ends of a first handle portion 13. Third fork/spoon implement 45 is formed having a second spoon-food engagement portion 21 and a first fork-food engagement portion 22 formed at respective ends of a second handle portion 23. First handle portion 13 and second handle portion 23 respectively further include a first androgynous clipping mechanism 50. As will be hereinafter described in greater detail the respective first androgynous clipping mechanisms 50 engaged each other to retain the third utensil 3 in a nested position.

The first spoon-food engagement portion 11 of third knife/spoon implement 40 is turned upwardly and is formed having the size and shape of a conventional teaspoon. The knife-food engagement portion 12 of third knife/spoon implement 40 is formed having the cutting edge 12*a* disposed laterally. The second spoon-food engagement portion 21 of third fork/spoon implement 45 is turned upwardly and is formed having the size and shape of a conventional tablespoon. The first fork-food engagement portion 22 of third fork/spoon implement 45 is formed having the fork tines 22*a* turned upwardly. These arrangements of the food engagement portions 11, 12, 21, 22 of the respective third implements 40, 45 facilitate nesting of the third set of utensils 3.

The androgynous construction of first androgynous clipping mechanism 50 permits each clipping mechanism of the third implements 40, 45 to support and likewise be supported in the clipping engagement of the respective implements 40, 45. The respective first androgynous clipping mechanisms 50 include a pair of wings 51, 52 extending from and integrally formed with the respective handle portions 13, 23 and a wing engagement portion 53 disposed adjacent to the handle portions 13, 23 integrally formed with the wings 51, 52. The wings 51, 52 of the third knife/spoon implement 40 engage the wing engagement portion 53 of the third fork/spoon implement 45 and the wings 51, 52 of the third fork/spoon implement 45 engage the wing engagement portion 53 of the third knife/spoon implement 40 in clipping engagement. As can be readily understood from FIGS. 5–7 the wings 51, 52 prevent lateral and vertical displacement of the respective third implements 40, 45. When engaged the wings 51, 52 of the respective third implements 40, 45 are disposed adjacent to each other and thereby prevent longitudinal displacement of the respective third implements 40, 45.

FIGS. 8–10 illustrate a second androgynous clipping mechanism 60 useful for secure nestable engagement of a pair of dual-end eating utensils. FIG. 8 is a fragmented side elevational view of second androgynous clipping mechanism 60 shown attached to the first spoon-food engagement portion 11, first knife-food engagement portion 12, second spoon-food engagement portion 21 and first fork-food engagement portion 22 of the first dual-end knife/spoon implement 10 and the first dual-end fork/spoon implement illustrated in FIG. 1. Second androgynous clipping mechanism 60 integrally forms the handle portions of both the first knife/spoon implement 10 and the first fork/spoon implement 20. In both implements 10, 20 the construction of second androgynous clipping mechanism 60 is identical. However, each respective second androgynous clipping mechanisms 60 is reversed in orientation. Referring now to FIG. 8 it can be seen that second androgynous clipping mechanism 60 in the knife/spoon implement 10 is oriented upwardly and is formed having a female clipping component 61 disposed to the right side of the second androgynous mechanism 60 and a male clipping component 62 disposed to the left side of the second androgynous mechanism 60. In the fork/spoon implement 20 second androgynous mechanism 60 is oriented downwardly and is formed having a female clipping component 61 disposed to the left side and a male clipping component 62 disposed to its right side. Second androgynous mechanism 60 of the knife/spoon implement 10 clips onto the third clipping mechanism 60 of the fork/spoon implement 20.

The structure of the respective female clipping component 61 and the male clipping component 62 of second androgynous clipping mechanism 60 can be better understood by reference to FIGS. 9 and 10. Female clipping component 61 includes a clipping slot 61*a* disposed to one side thereof. First and second clipping detents 61*b*, 61*c* are formed in opposing side walls of the clipping slot 61*a*. Clipping detents 61*b*, 61*c* extend laterally from the respective side walls of clipping slot 61*a*. Male clipping component 62 includes a clipping slot tongue 62*a* having first and second tongue slots 62*b*, 62*c* formed in opposing side walls of clipping slot tongue 62*a*. The clipping slot tongue 62*a* engages clipping slot 61*a* having the first and second clipping detents 61*b*, 61*c* of clipping slot 61*a* snap fit into the first and second tongue slots 62*b*, 62*c* of clipping slot tongue 62*a*.

The androgynous constructions of first and second androgynous clipping mechanisms 50, 60 has certain manufacturing advantages. A single mold may be utilized to construct the handle portions for both sets of implements in a set of dual-end eating utensils. This permits various food engagement portions to be integrally formed or formed from different material than the clipping mechanism at the respective ends of an androgynous clipping mechanisms 50, 60. Thus the single mold for the androgynous clipping mechanisms 50, 60 can be utilized to provide a wide variety of eating utensil configurations and material constructions.

Various changes, additions and modifications to the preferred embodiments of the present invention may be made without departing from the spirit and scope of this disclosure. Such changes, additions and modifications within a fair reading of the appended claims are intended as part of the present invention.

Therefore, in view of the foregoing, I claim:

1. A combination eating utensil 1 comprising:

a first dual-end implement having a first food engagement portion and a second food engagement portion formed at opposing ends of a first handle portion, said first handle portion having a first part of a clip locking mechanism formed therein comprising first and second clip locking slots formed in opposing sides of said first handle portion, and a second dual-end implement having a third food engagement portion and a fourth food engagement portion formed at opposing ends of a second handle portion, said second handle portion having a second part of the clip locking mechanism comprising first and second clip locking arms extending from said second handle portion, said first and second clip locking arms including first and second clip locking fingers cooperably engageable to prevent displacement of said first dual-end implement and said second dual-end implement when the combination eating utensil is disposed in a nested storage position.

2. A combination eating utensil comprising:

a first dual-end implement having a first food engagement portion and a second food engagement portion formed at opposing ends of a first handle portion, said first handle portion having a first part of a clip locking mechanism formed therein, a second dual-end implement having a third food engagement portion and a fourth food engagement portion formed at opposing ends of a second handle portion, said second handle portion having a second part of the clip locking mechanism formed therein, said clip locking mechanism comprising at least one arm projecting from one of said handle portions and cooperably engageable with at least one slot formed on the other of said handle portions to prevent displacement of said first dual-end implement and said second dual-end implement when the combination eating utensil is disposed in a nested storage position.

3. A combination eating utensil as in claim 2 wherein said first food engagement portion comprises a first spoon bowl, said second food engagement portion comprises a knife blade, said third food engagement portion comprises a plurality of fork tines and said fourth food engagement portion comprises a second spoon bowl.

4. A combination eating utensil as in claim 3 wherein said first spoon bowl is formed having a different size than said second spoon bowl.

5. A combination eating utensil as in claim 3 wherein said first spoon bowl is formed having the size of a teaspoon and said second spoon bowl is formed having the size of a tablespoon.

6. A combination eating utensil as in claim 2 wherein the first part of said clip locking mechanism comprises an upright clipping arm that extends from the first handle portion.

7. A combination eating utensil as in claim 6 wherein the second part of said clip locking mechanism comprises a longitudinal slot formed in the second handle portion, said upright clipping arm being cooperably engageable in the longitudinal slot.

8. A combination eating utensil as in claim 2 wherein the first part of said clip locking mechanism comprises a male clipping mechanism and the second part of said clip locking mechanism comprises a female clipping mechanism.

* * * * *